US007524155B2

(12) United States Patent
Hata et al.

(10) Patent No.: US 7,524,155 B2
(45) Date of Patent: Apr. 28, 2009

(54) BOOKBINDING APPARATUS AND IMAGE FORMING SYSTEM

(75) Inventors: Kiyoshi Hata, Hachioji (JP); Saburo Shimizu, Hachioji (JP); Kohji Yoshie, Sagamihara (JP); Riichi Hama, Hachioji (JP); Masahiro Kaneko, Hino (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 168 days.

(21) Appl. No.: 11/439,170

(22) Filed: May 24, 2006

(65) Prior Publication Data

US 2007/0036637 A1 Feb. 15, 2007

(30) Foreign Application Priority Data

Aug. 11, 2005 (JP) ..... 2005-232897

(51) Int. Cl.
*B42C 11/00* (2006.01)
*B42C 11/02* (2006.01)
*B42C 11/04* (2006.01)

(52) U.S. Cl. ..... 412/19; 412/4; 412/5; 412/21

(58) Field of Classification Search ..... 412/9, 412/11, 14, 16, 28, 33, 37, 4, 5, 17, 19; 270/32, 270/37, 58.07, 58.08
See application file for complete search history.

(56) References Cited

U.S. PATENT DOCUMENTS 4,484,850 A * 11/1984 Shimizu ..... 412/11
5,980,182 A * 11/1999 Yen ..... 412/21
6,193,458 B1 * 2/2001 Marsh ..... 412/1
6,685,416 B2 * 2/2004 Itoh et al. ..... 412/37
6,966,552 B2 * 11/2005 Trovinger et al. ..... 270/52.17

* cited by examiner

*Primary Examiner*—Dana Ross
*Assistant Examiner*—Kyle Grabowski
(74) *Attorney, Agent, or Firm*—Finnegan, Henderson, Farabow, Garrett & Dunner, L.L.P.

(57) ABSTRACT

A bookbinding apparatus for bookbinding such that a cover sheet forms a front and a back cover by bonding the cover sheet to a spine portion of a bundle of sheets, the bookbinding apparatus including a cover-sheet outfitting device which can be raised and lowered for holding and conveying a cover sheet to the cover sheet bonding position where the cover sheet is bonded to a bundle of sheets and a cover-sheet trimming device for trimming a cover sheet conveyed from the cover-sheet outfitting device, to a predetermined length prior to bonding the cover sheet to the bundle of sheets wherein the cover-sheet outfitting device is integrally formed with the cover-sheet trimming device.

13 Claims, 15 Drawing Sheets

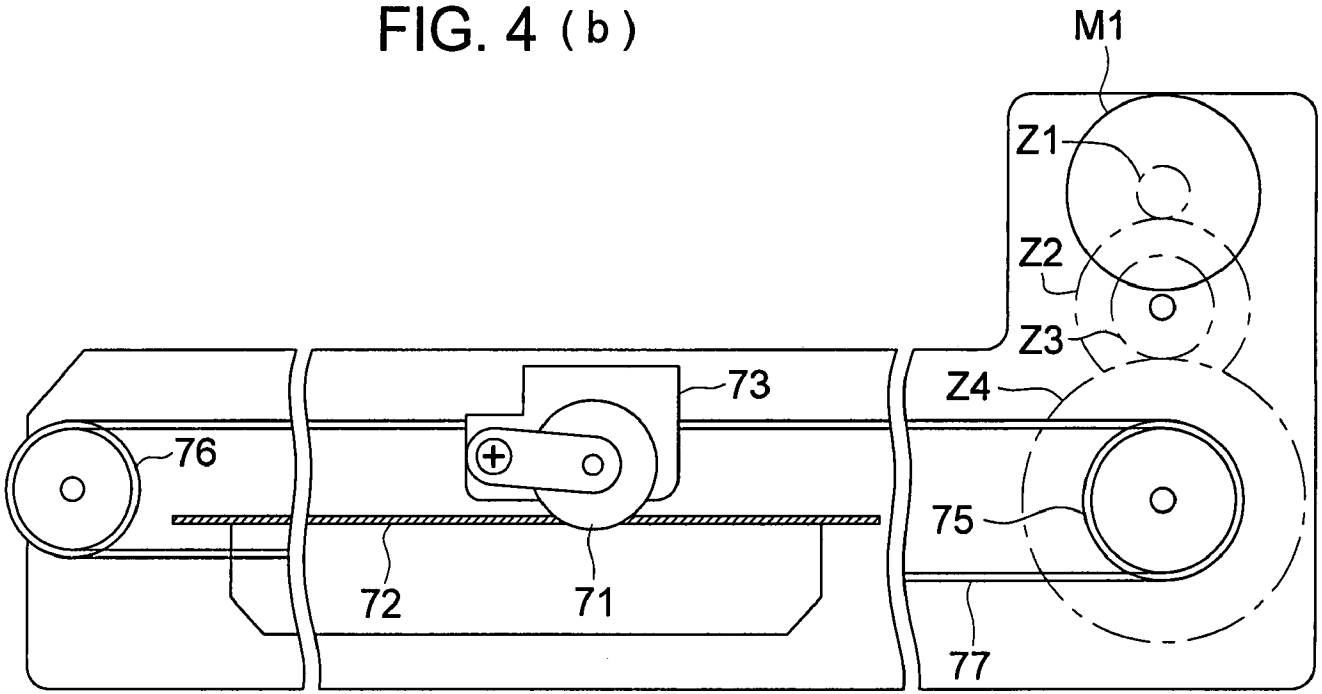
FIG. 4 ( b )
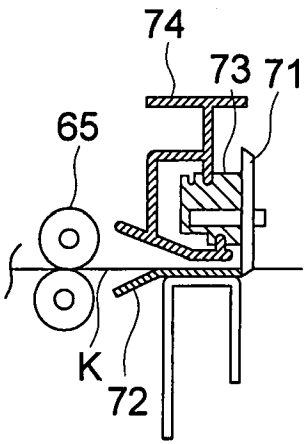
FIG. 4 ( a )

BOOKBINDING APPARATUS AND IMAGE FORMING SYSTEM

This application is based on Japanese Patent Applicaiton No. 2005-232897 filed on Aug. 11, 2005 in Japanese Patent Office, the entire content of which is hereby incorporated by reference.

BACKGROUND OF THE INVENTION

The present invention relates to a bookbinding apparatus that makes a booklet by covering the spine portion, the front and the back of the bundle of sheets with a cover sheet, and in particular, to an image forming system equipped with a bookbinding apparatus which can be connected to an image forming apparatus such as a copying machine, a facsimile machine or a printer to be applied.

Bookbinding is known as a method of binding a bundle of sheets as a collection of printed sheets by stapling or pasting.

Apparatuses known as a pasting and bookbinding apparatus include a device to jet paste on a sheet by using a paste jetting nozzle, a device wherein a paste roller is installed in a paste container, and paste adheres to an outer circumference of the rotating paste roller to be transferred onto a sheet when the outer circumference of the rotating paste roller touches the sheet, a hot-melt coating device that jets a mixture containing hot-melt agents (heat fusing agents) and heated and compressed air from a nozzle, and a tape sticking device that sticks a tape on which adhesive paste is coated in advance on the spine portion of a sheet bundle while the tape is heated.

For example, an image forming apparatus based on electrophotographic technology is characterized by high speed, multi-function performance and network functions. Its applications as a printing apparatus are much increased when it is connected with a large-capacity sheet feeding apparatus and a large-capacity stacker.

When an image forming apparatus according to electrophotographic technology is used as a printing apparatus, all the operations ranging from printing to binding can be performed by one apparatus if connected with a bookbinding apparatus for binding printed matter.

An image forming system wherein an image forming apparatus is connected with a downsized pasting and bookbinding apparatus is proposed in the bookbinding apparatus described in the Patent Documents 1 and 2.

[Patent Document1] Unexamined Japanese Patent Application Publication No. 2004-209869

[Patent Document2] Unexamined Japanese Patent Application Publication No. 2004-209870

SUMMARY

The bookbinding apparatus and image forming system of the present invention are designed to have the following structure:

(1) A bookbinding apparatus for bookbinding such that a cover sheet forms a front and a back cover by bonding a cover sheet to the spine portion of a bundle of sheets including a cover-sheet outfitting device which can be raised and lowered for holding and conveying the cover sheet to a cover sheet bonding position where the cover sheet is bonded to a bundle of sheets, and a cover-sheet trimming device for trimming the cover sheet conveyed from the cover-sheet outfitting device, to a predetermined length prior to bonding the cover sheet to the bundle of sheets, wherein the cover-sheet outfitting device is integrally formed with the cover-sheet trimming device.

(2) An image forming system including an image forming apparatus body provided with an image forming device and a sheet conveyance device, and the bookbinding apparatus described in (1) for bookbinding the sheets conveyed from the image forming apparatus body.

(3) A bookbinding apparatus for bookbinding such that a cover sheet forms a front and a back cover by bonding the cover sheet to the spine portion of a bundle of sheets including a cover-sheet outfitting device which can be raised and lowered for holding and conveying the cover sheet to a cover sheet bonding position where the cover sheet is bonded to a bundle of sheets, wherein the cover-sheet outfitting device includes an alignment device to regulate the end of the cover sheet in the width direction so as to position the cover sheet, and a cover-sheet trimming device for trimming the cover sheet positioned by the alignment device, to a predetermined length prior to bonding the cover sheet to the bundle of sheets.

(4) An image forming system including an image forming apparatus body provided with an image forming device and a sheet conveyance device; and the bookbinding apparatus described in (3) for bookbinding the sheets conveyed from the image forming apparatus body.

BRIEF DESCRIPTION OF THE DRAWINGS

FIGS. 4(*a*) and 4(*b*) are a cross sectional view and a front view of the cover-sheet trimming device.

DETAILED DESCRIPTION OF THE PREFERRED EMBODIMENT

Figure 1:
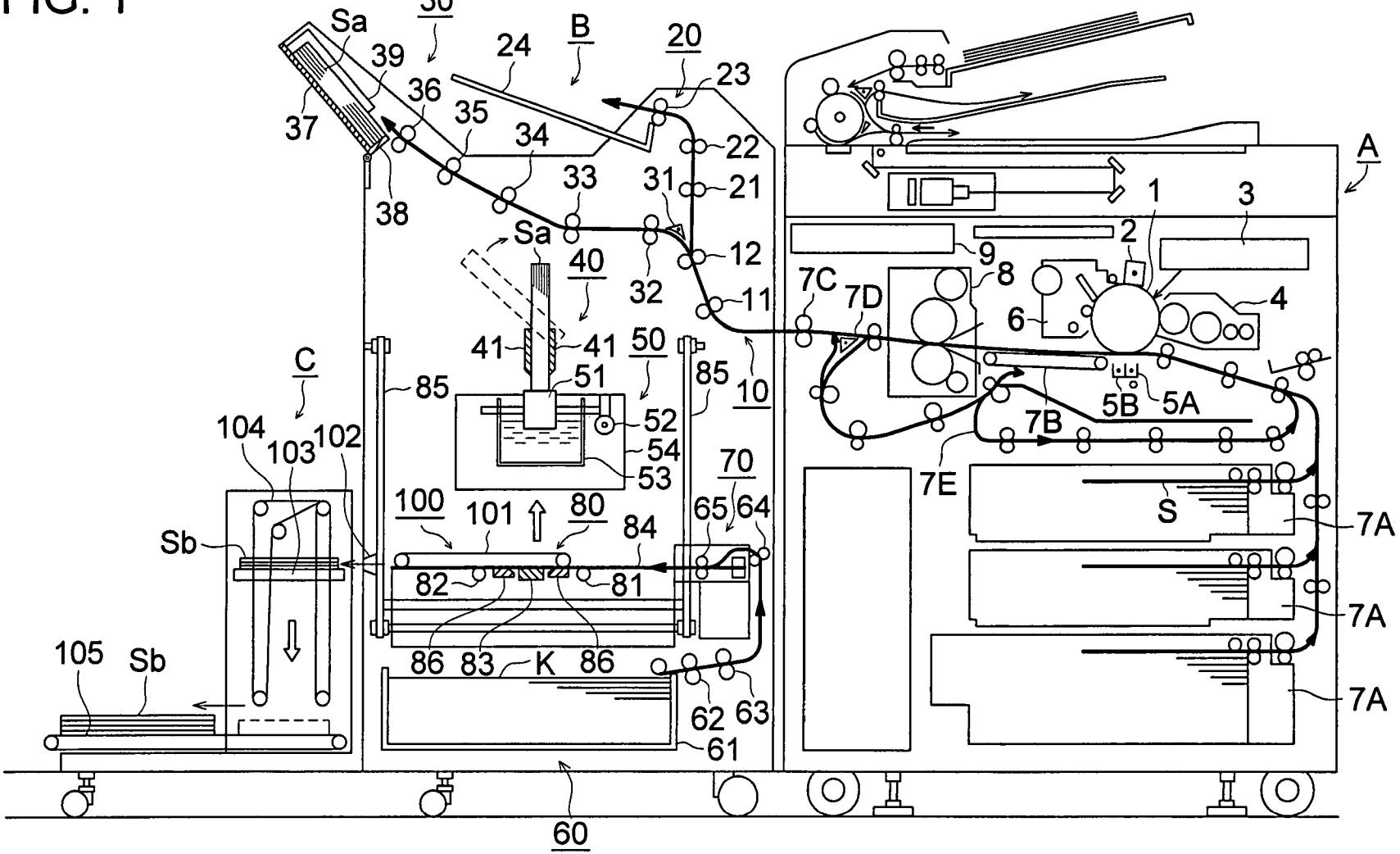
FIG. 1 is an overall schematic diagram representing an image forming system including an image forming apparatus, a bookbinding apparatus and a sheet ejection apparatus.

Next, a bookbinding apparatus of the invention and an image forming system provided with the bookbinding apparatus will be explained as follows, referring to the drawings.

[Image Forming System]

Figure 2:
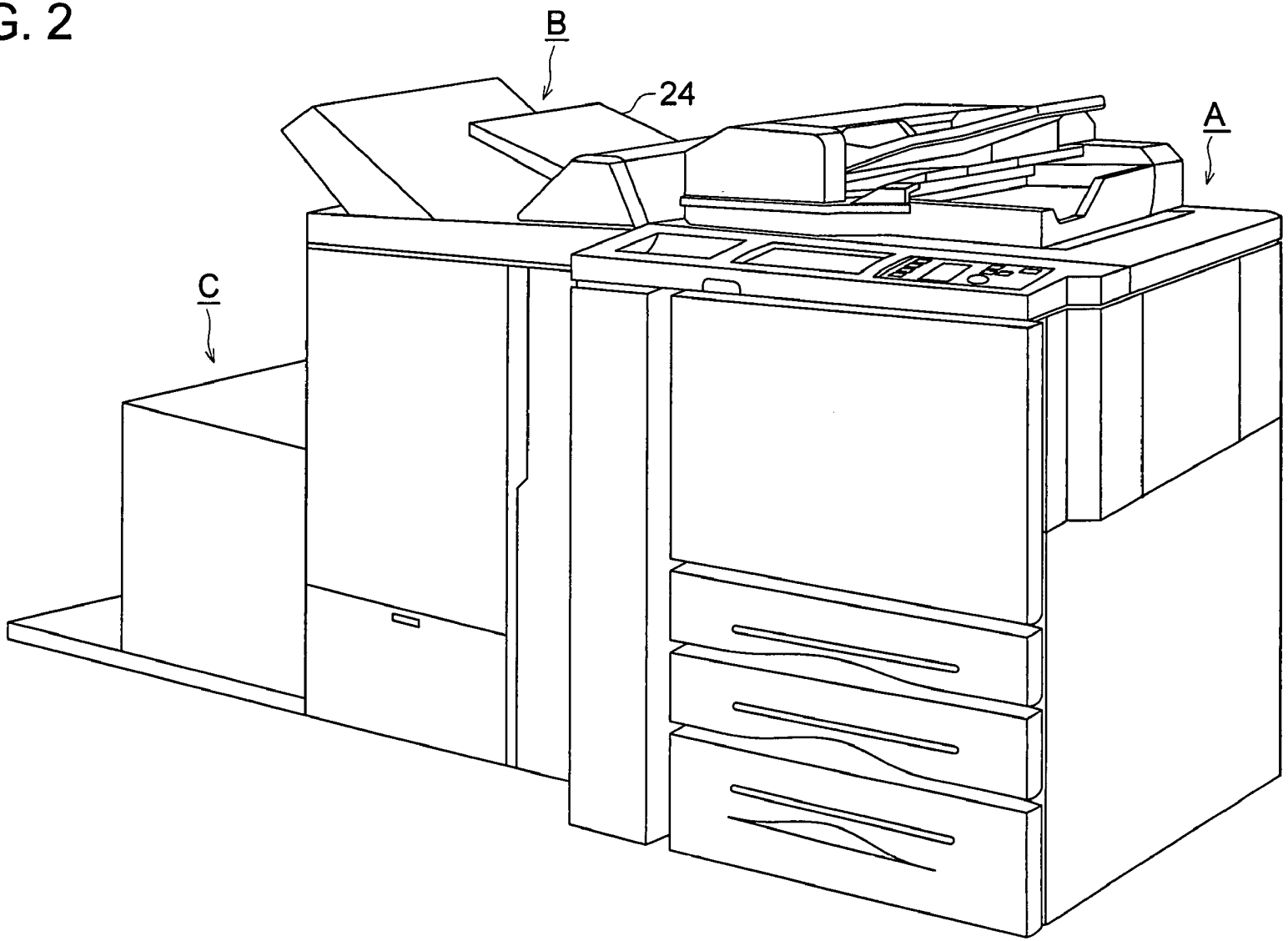
FIG. 2 is a perspective view representing the external appearance of the image forming system.

FIG. 1 is an entire structure diagram of an image forming system equipped with image forming apparatus A, bookbinding apparatus B and sheet ejection apparatus C and FIG. 2 is a perspective view of an appearance of the image forming system.

[Image Forming Apparatus]

Image forming apparatus A has an image forming unit wherein charging unit 2, image exposure unit 3, developing unit 4, transfer unit 5A, neutralizing unit 5B and cleaning unit 6 are arranged around rotary image carrier 1. In the image forming unit, exposure scanning based on image data obtained from a document through reading by a laser beam of the image exposure unit 3 is conducted after a surface of the image carrier 1 is charged evenly by the charging unit 2, to form a latent image, and the latent image is developed reversely by the developing unit 4, and a toner image is formed on a surface of the image carrier 1.

Sheet S fed from sheet storing section 7A is transported to a transfer position. In the transfer position, the toner image stated above is transferred onto sheet S by the transfer unit 5A. After that, charges on the reverse side of the sheet S is eliminated by the neutralizing unit 5B and the sheet S is separated from the image carrier 1 to be transported by transportation section 7B, and then, is heated and fixed by fixing unit 8 to be ejected from sheet ejection roller 7C.

When forming images on both sides of sheet S, sheet S subjected to heating and fixing by fixing unit 8 is diverged from an ordinary sheet ejection path by transportation path changeover device 7D, then, is reversed upside down through a movement in a form of a switchback in reversing transportation section 7E, and passes through the image forming section again so that an image is formed on the back of sheet S, and is ejected out of the apparatus from sheet ejection roller 7C through fixing unit 8. Sheet S ejected from the sheet ejection roller 7C is fed into bookbinding apparatus B.

With respect to the surface of image carrier 1 after image processing, developing agents remaining on the surface are removed by cleaning unit 6 so that the image carrier 1 turns out to be ready for the succeeding image forming.

[Bookbinding Apparatus]

Figure 3:
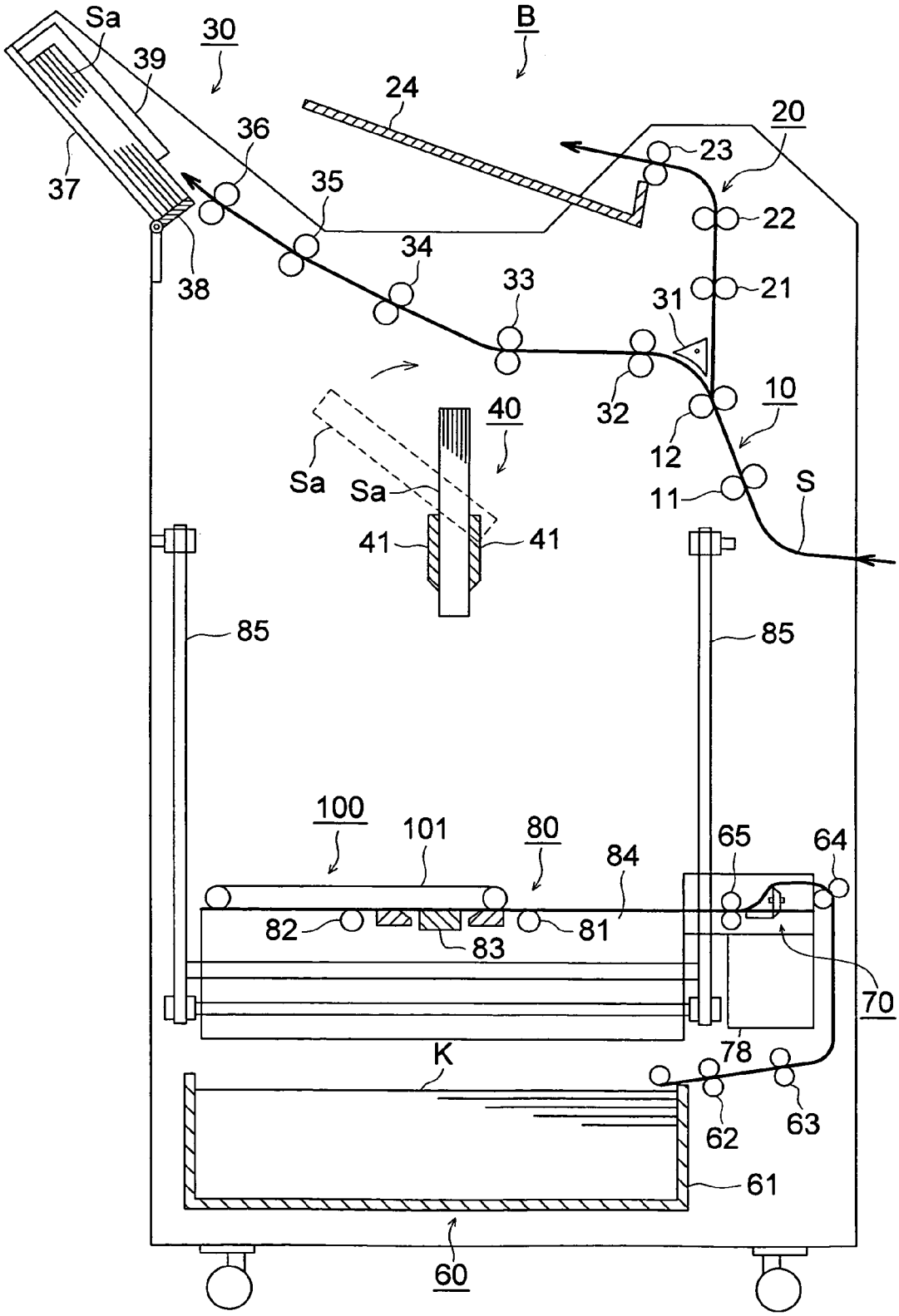
FIG. 3 is a cross sectional view showing the sheet conveyance path of a bookbinding apparatus of the present invention.

FIG. 3 is a sectional view showing a sheet transportation path of bookbinding apparatus B relating to the invention.

Bookbinding apparatus B is composed of sheet introduction unit 10, sheet ejection unit 20, sheet bundle loading unit 30, sheet bundle transportation unit 40, paste coating unit 50, cover-sheet supply unit 60, cover-sheet trimming device 70, cover-sheet outfitting device 80 (wrapping-bookbinding unit), alignment device 90 (see FIG. 5) and booklet ejection unit 100. The respective units are arranged nearly longitudinally and vertically in the main body of the bookbinding apparatus.

<Sheet Introduction Unit 10>

Sheet S that has been introduced into the sheet introduction unit 10 is interposed between inlet rollers 11 and 12 to be transported, and is diverged by transportation path changeover device 31 to either one of the sheet ejection unit 20 and the sheet bundle loading unit 30.

<Sheet Ejection Unit 20>

After this sheet transportation is established, the transportation path changeover device 31 closes a transportation path leading to the sheet bundle loading unit 30, and opens a transportation path leading to the sheet ejection unit 20.

Sheet S passing through a transportation path leading to the sheet ejection unit 20 is interposed between transporting rollers 21 and 22 to be transported upward, and is ejected by sheet ejection roller 23 and housed in stationary sheet ejection tray 24 located at the uppermost portion of the apparatus. On stationary sheet ejection tray 24, sheet S ejected from image forming apparatus A is directly received, and about a maximum of 200 sheets can be stacked thereon.

<Sheet Bundle Loading Unit 30>

Sheet S diverged to the left side in the drawing located at the downstream side in the sheet transportation direction by transportation path changeover device 31 is interposed by transporting rollers 32, 33, 34, 35 and 36 to be housed at the prescribed position of sheet bundle loading unit 30 and to be stacked thereon in succession, thus, sheet bundle Sa formed by prescribed number of sheets S is formed. The sheet bundle loading unit 30 is composed of sheet loading table 37 that is arranged obliquely, movable sheet trailing edge positioning member 38 and sheet width aligning member 39 that aligns sheets in the sheet width direction.

<Sheet Bundle Transportation Unit 40>

Sheet bundle Sa stacked on the sheet loading table 37 of sheet bundle loading unit 30 is transported downward obliquely by an unillustrated pushing-out device. After that, the sheet bundle Sa is held by holding unit 41 of the sheet bundle transportation unit 40, and is turned while it is held so that the surface of the sheet bundle Sa to be subjected to paste coating processing (spine portion) may face downward, to be stopped at the prescribed position.

<Paste Coating Unit 50>

Paste coating unit 50 is composed of paste coating member (which is also called a coating roller) 51, rotating unit 52 for rotational driving of the coating roller 51, paste container 53 that contains paste, movable body 54 that is movable from the rear surface side of bookbinding apparatus B which is the initial position to the front surface side which is the paste coating position while holding the paste container 53, and an unillustrated moving unit that reciprocates the movable body 54.

<Cover-Sheet Supply Unit 60>

Cover sheet K housed in sheet feeding tray 61 of cover-sheet supply unit 60 is separated and fed by sheet feeding unit 62, interposed by transporting rollers 63, 64 and 65, and transported to cover-sheet outfitting device 80.

<Cover-Sheet Trimming Device 70>

The cover-sheet trimming device 70 integrally formed on the upper right of the illustrated cover-sheet supply device 60 and on the right of an illustrated cover-sheet outfitting device 80 (to be described later) is used to trim the length of a cover sheet K to a predetermined value in the direction of conveyance.

FIG. 4(*a*) is a cross sectional view of the cover-sheet trimming device, and FIG. 4(*b*) is a front view thereof.

The cover-sheet trimming device 70 is a roller cutter unit made of a rotary knife 71 and stationary knife 72. The rotary knife 71 is supported rotatably by a moving member 73. The moving member 73 is slidably in contact with the guide surface of the support member 74 to make a linear movement.

The motor Ml rotates the drive pulley 75 through the gears Z1, Z2, Z3 and Z4 of the drive transmission device. The belt 77 driven by the driving pulley 75 and driven pulley 76 causes linear movement of the moving member 73 engaged with a part of the belt 77 along the guide surface of the support member 74.

The knife surface formed on the end of the stationary knife 72 fixed below the support member 74 comes slidably in contact with the knife surface of the rotary knife 71 supported by the moving member 73.

A cover sheet K is fed between the cover sheet introducing surface of the support member 74 and the cover sheet introducing surface of the stationary knife 72. When it has stopped at a predetermined position, the belt 77 is driven by the drive of the motor M1. When the moving member 73 engaged with the belt 77 starts a linear motion from the initial position, the rotary knife 71 rotates by sliding along the stationary knife 72, and cuts the cover sheet K in the width direction of the cover sheet. The waste of the cover sheet K having been cut drops and is stored in the chip box 78 (see FIG. 3) located below the stationary knife 72.

The length of the cover sheet K having been trimmed corresponds to the value obtained by adding the length (thickness) of the spine portion of the bundle of sheets Sa to the length of two sheets S in the direction of conveyance.

In the operation section 9 of the image forming apparatus A, when the sheet size, number of sheets and the thickness of the sheets have been selected or detected, the control unit sets a predetermined length of the cover sheet K having been trimmed. The length of the cover sheet K before trimming is determined in response to the maximum number of the sheets, and sheets of this size are stored in the sheet feed tray 61 of the cover-sheet supply device 60. In the present embodiment, a roller cutter unit using a rotary knife is adopted. It is also possible to use a so-called guillotine type cutter unit wherein a movable knife moves in the vertical direction.

<Cover-Sheet Outfitting Device 80>

Cover-sheet outfitting device 80 is composed of transporting rollers 81 and 82 which receive cover sheet K supplied from cover-sheet supply unit 60 to transport it and to stop it at the prescribed position, pressing member 83 that brings cover sheet K into pressure contact with a paste-coated surface of sheet bundle Sa, movable casing 84 that supports the transporting rollers 81 and 82 and the pressing member 83 and elevating unit that makes it possible for the movable casing 84 to move up and down vertically.

Figure 15:
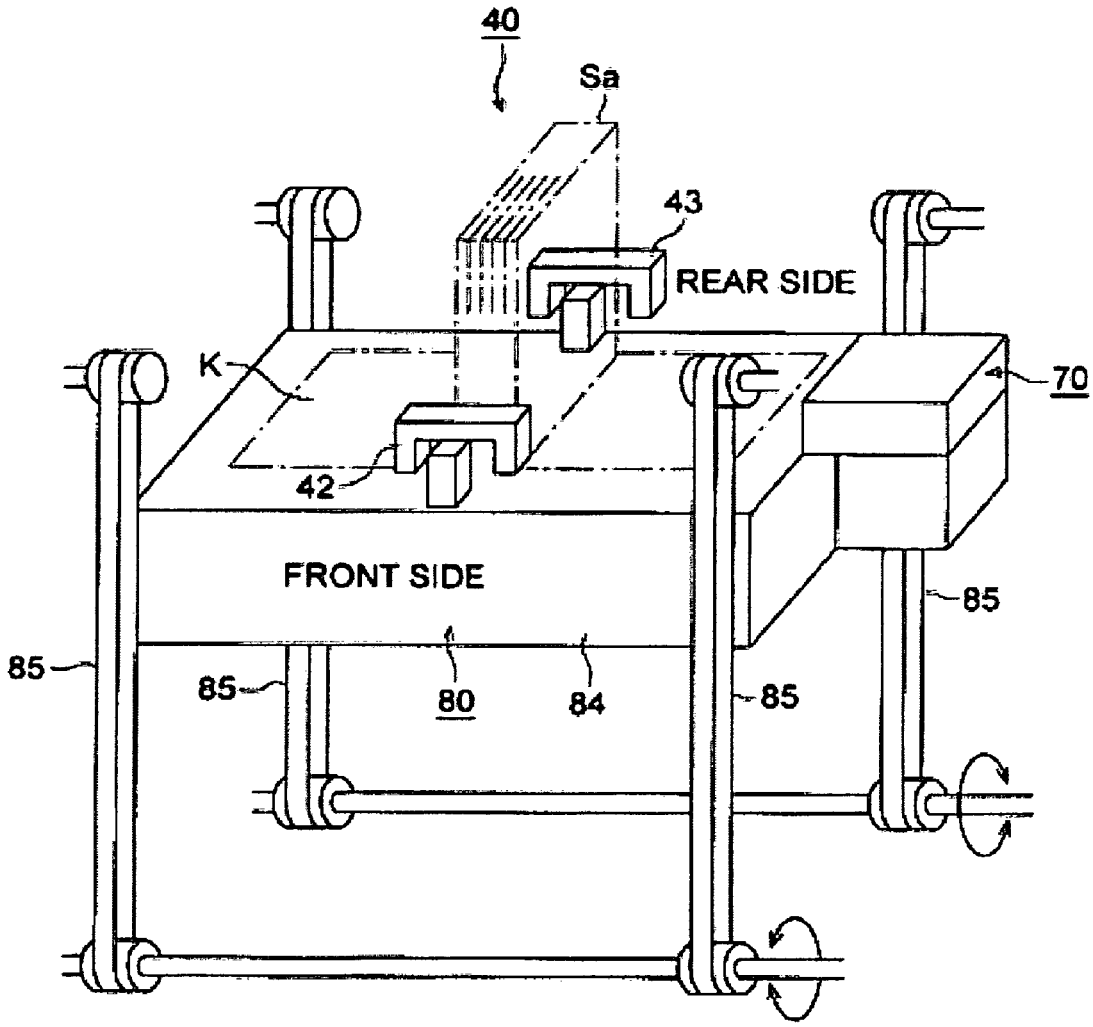
FIG. 15 is a perspective view of an angle adjusting mechanism for a cover-sheet outfitting device.

A movable casing 84 is moved to a raised position by turning the belt 85 of an elevation device. At this raised position, the middle portion of the cover sheet K mounted on the pressing member 83 is pressed and bonded to the pasted surface of a bundle of sheets Sa. The support shaft for holding the holding device 40 is provided with sensors 42 and 43 on the front side and the rear side of the bookbinding apparatus (refer to FIG. 15). The cover-sheet outfitting device 80 is detected by these sensors 42 and 43 when moving to the raised position. Based on the result of detection by each sensor, each of the belts 85 on the front and back of the apparatus is driven under control. This allows the angle of the cover-sheet outfitting device 80 to be adjusted with reference to the horizontal plane. Thus, the cover-sheet outfitting device 80 can be stopped so that the cover sheet K is parallel to the spine surface of the bundle of sheets Sa held by the holding device 40 at the raised position. This ensures closer adhesion of the cover sheet K to the spine surface of the bundle of sheets Sa, and hence results in production of a high-quality booklet.

<Alignment Device 90>

Figure 5:
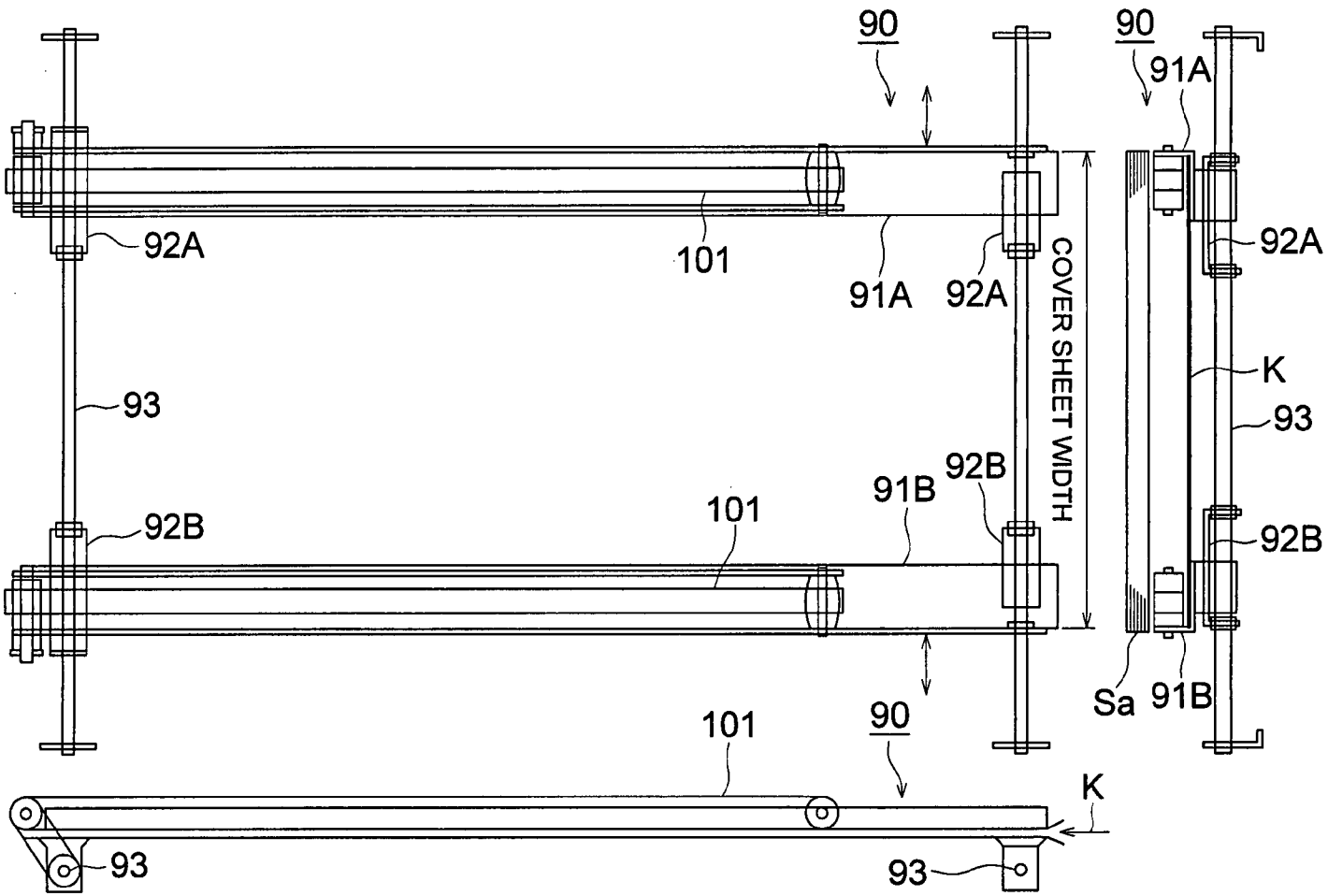
FIGS. 5(*a*) and 5(*b*) and 5(*c*) are a plan view, a side view and a front view of an alignment device and an ejection belt provided on the alignment device.
Figure 6:
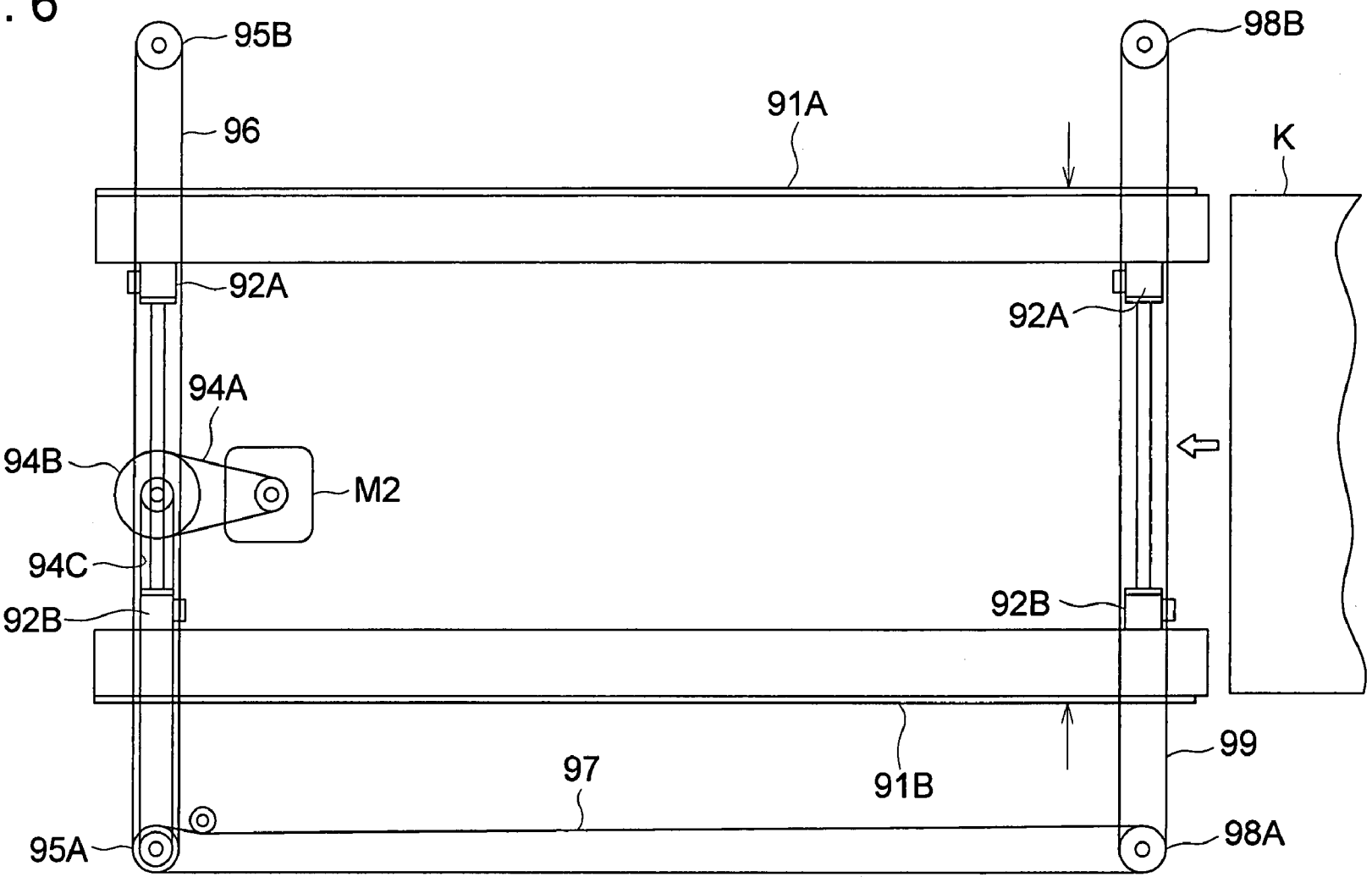
FIG. 6 is a plan view of the drive unit of the alignment device.

FIG. 5(*a*) is a plan view showing an alignment device 90 and an ejection belt provided on the alignment device. FIG. 5(*b*) is a side view thereof and FIG. 5(*c*) is a front view thereof. FIG. 6 is a plan view of the drive device of the alignment device 90.

An alignment device 90 and an ejection belt 101 are arranged on the upper portion of the cover-sheet outfitting device 80. The alignment device 90 is provided with a pair of alignment plates 91A and 91B movable in the width direction of the cover sheet K; a pair of support members 92A and 92B for supporting the alignment plates 91A and 91B; and two guide bars 93 movably guiding the support members 92A and 92B in the width direction of the cover sheet.

The motor M2 shown in FIG. 6 rotates the pulley 95A through the belt 94A, intermediate pulley 94B and belt 94C. The belt 96 winding the pulley 95A winds and rotates the other pulley 95B arranged symmetrical therewith in the width direction of the cover sheet.

The pulley 95A rotates pulley 98A through the belt 97. The belt 99 winding the pulley 98A winds and rotates the other pulley 98B arranged symmetrical therewith in the width direction of the cover sheet.

The support member 92A is engaged with each of the parts of the belts 96 and 99. The support member 92B is engaged with each of the other parts of the belts 96 and 99. The alignment plates 91A and 91B are shifted toward the midpoint in the width direction of the cover sheet by the forward rotation of the motor M2, and the cover sheet K is aligned by the alignment plates 91A and 91B. Further, the alignment plates 91A and 91B are fed to the ends in the width direction of the cover sheet by the reverse rotation of the motor M2, and are retracted to the initial position.

When the cover-sheet outfitting device 80 has stopped at the lowered position to introduce the cover sheet K, the alignment device 90 shifts from the initial position to press both sides of the cover sheet K before being trimmed, in the width direction, whereby widthwise alignment is performed. The cover sheet K having been subjected to widthwise alignment free from skew is switched back in the direction opposite to the direction of introduction. After being conveyed to the cover-sheet trimming device 70, the sheet cover K is trimmed at a predetermined position.

Before the cover sheet K having been trimmed is bonded to the spine portion of the bundle of sheets Sa at the lowered position of the cover-sheet outfitting device 80, the alignment device 90 again shifts from the initial position and presses both sides in the width direction of the cover sheet K to provide widthwise alignment. The cover sheet K is placed at a predetermined position. Then the alignment device 90 retracts, but the cover-sheet outfitting device 80 is raised while the cover sheet K is kept at a predetermined position where it has been placed.

Thus, the alignment device 90 installed on the cover-sheet outfitting device, which can be raised and lowered, determines the position of the cover sheet in the width direction before and after the cover sheet K is trimmed by the cover-sheet trimming device 70, whereby the cover sheet trimming precision and the cover sheet outfitting precision are improved, and the structure is simplified.

The bound booklet Sb having been produced by bonding the cover sheet K to the bundle of sheets Sa to be wrapping-folded for forming the front and back cover is ejected out of the apparatus by the ejection belt 101 arranged on the upper portion of the alignment device 90.

<Cover Sheet Folding Process>

Cover-sheet folding unit is provided over the cover-sheet outfitting device 80. The cover-sheet folding unit has therein a pair of folding members 86 which are bilaterally symmetrical. The folding members 86 can come in contact with and separate from cover sheet K in the thickness direction of sheet bundle Sa. The folding members 86 fold cover sheet K along a side edge of the paste-coated surface of the sheet bundle Sa, and superposes a front cover sheet and a back cover sheet respectively on the front and the back of the sheet bundle Sa.

Upon completion of the step of folding the cover sheet K, the cover-sheet outfitting device 80 is lowered by the downward drive of the belt 85 and is moved to a retracted position. Then the ejection belt 101 having retracted outside in the width direction of the cover sheet K, together with the retreat of the alignment device 90, moves to the inside of booklet Sb in the width direction below the booklet Sb and stops there. After that, when the grip of the holding device 41 has been released, the booklet Sb moves downward, and is stopped at the position where the spine portion of lower part of the booklet Sb comes in contact with the upper surface of the ejection belt 101.

<Booklet Ejection Unit 100>

Booklet Sb wherein cover sheet K is bonded to the paste-coated spine portion of the sheet bundle Sa (opposite side of the fore edge) and a front cover, a back cover and a spine cover are formed is ejected out of the apparatus from ejection outlet 102 to exterior sheet ejection apparatus C by an ejection belt 101.

<Sheet Ejection Apparatus C>

The booklets Sb having been ejected from the ejection belt 101 are sequentially placed on the elevation type sheet ejection stand 103 of the sheet ejection apparatus C shown in FIG. 1. When the booklets Sb have been ejected and placed on the elevation type sheet ejection stand 103, the elevation type sheet ejection stand 103 is lowered gradually by the rotating wire 104. When the elevation type sheet ejection stand 103 has reached the bottom end, the booklet Sb is transferred to the conveyance belt 105 and is ejected out of the apparatus by the drive of the conveyance belt 105.

<Transportation of a Sheet Bundle and a Cover Sheet>

Sheet bundle Sa composed of sheets S in a prescribed number stacked and aligned on sheet loading table 37 of sheet bundle loading unit 30 are held by holding unit 41 as shown in FIG. 3. Sheet trailing edge positioning member 38 is swung by an unillustrated driving unit, and retreats under sheet loading table 37. The holding unit 41 holding sheet bundle Sa moves downward obliquely as shown by dotted lines in the drawing, and rotates to be held in the erected state so that a surface of the sheet bundle Sa to be subjected to paste coating processing may face downward, and it stops at a prescribed position.

On the other hand, cover sheet K loaded in sheet feeding tray 61 of cover-sheet supply unit 60 is separated, sheet by sheet, by sheet feeding unit 62 to be fed, is interposed by transporting rollers 63, 64 and 65 then, and is transported by transporting rollers 81 and 82 of cover-sheet outfitting device 80, and is stopped at a prescribed position. After this, cover sheet K is aligned by alignment device 90 and switchback transportation is conducted on cover sheet K toward cover-sheet trimming device 70.

Cover-sheet trimming device 70 arranged at the right side of the transporting roller 65 in the drawing cuts cover sheet K in a prescribed length in the direction for transporting cover sheet K. Namely, since a length of cover sheet K in its transportation direction varies depending on a sheet size and a thickness of sheet bundle Sa, a wrapping length of cover sheet K is calculated, and an excessive portion of cover sheet K is cut by cover-sheet trimming device 70 in an optimum length prior to cover bonding, by inputting or detecting a sheet size, the number of sheets S and a thickness of sheet S in advance.

<Paste Coating on a Sheet Bundle>

Figure 7:
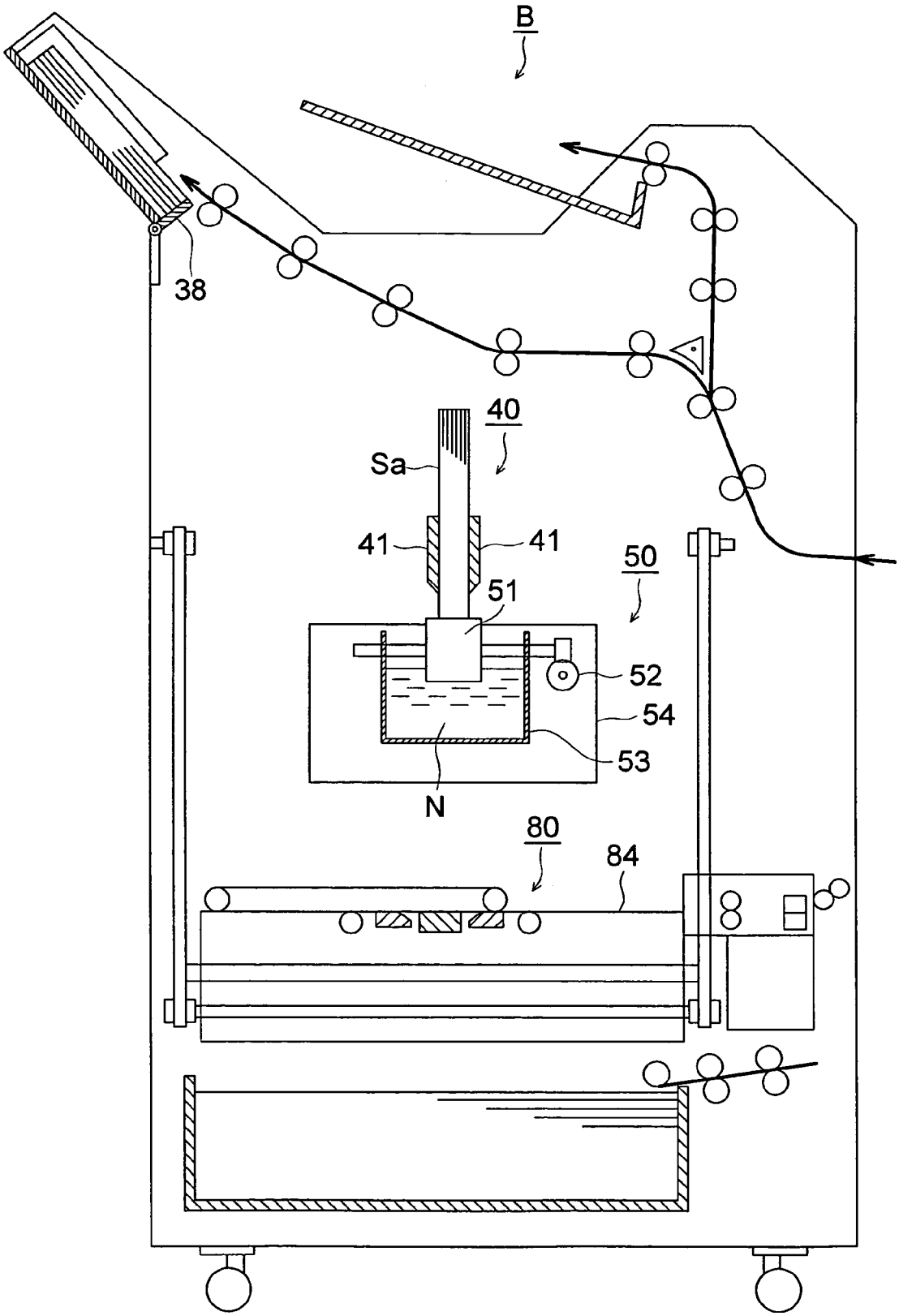
FIG. 7 is a cross sectional view of the bookbinding apparatus showing the process of applying paste on a bundle of sheets.
Figure 8:
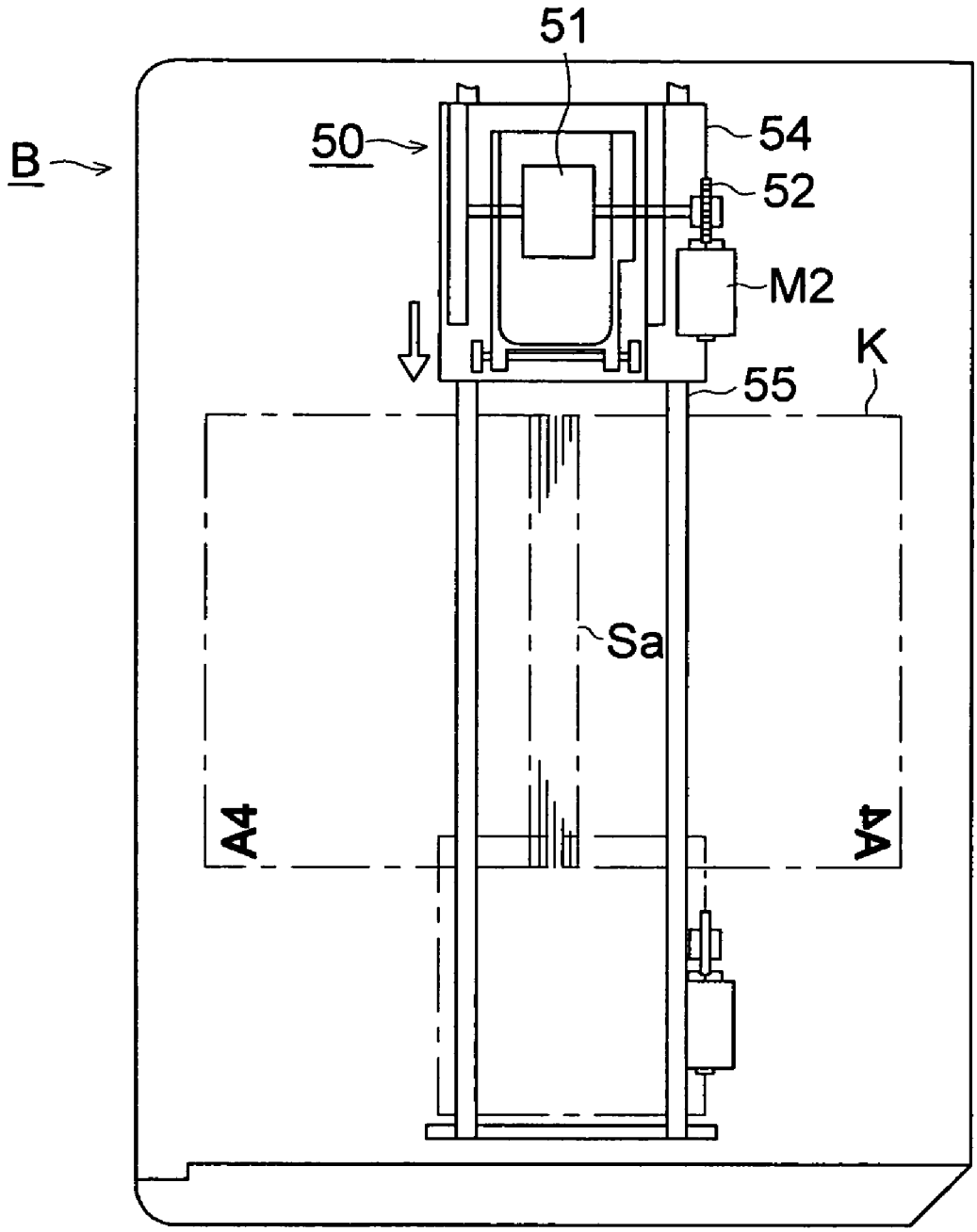
FIG. 8 is a plan view of a pasting device.
Figure 9:
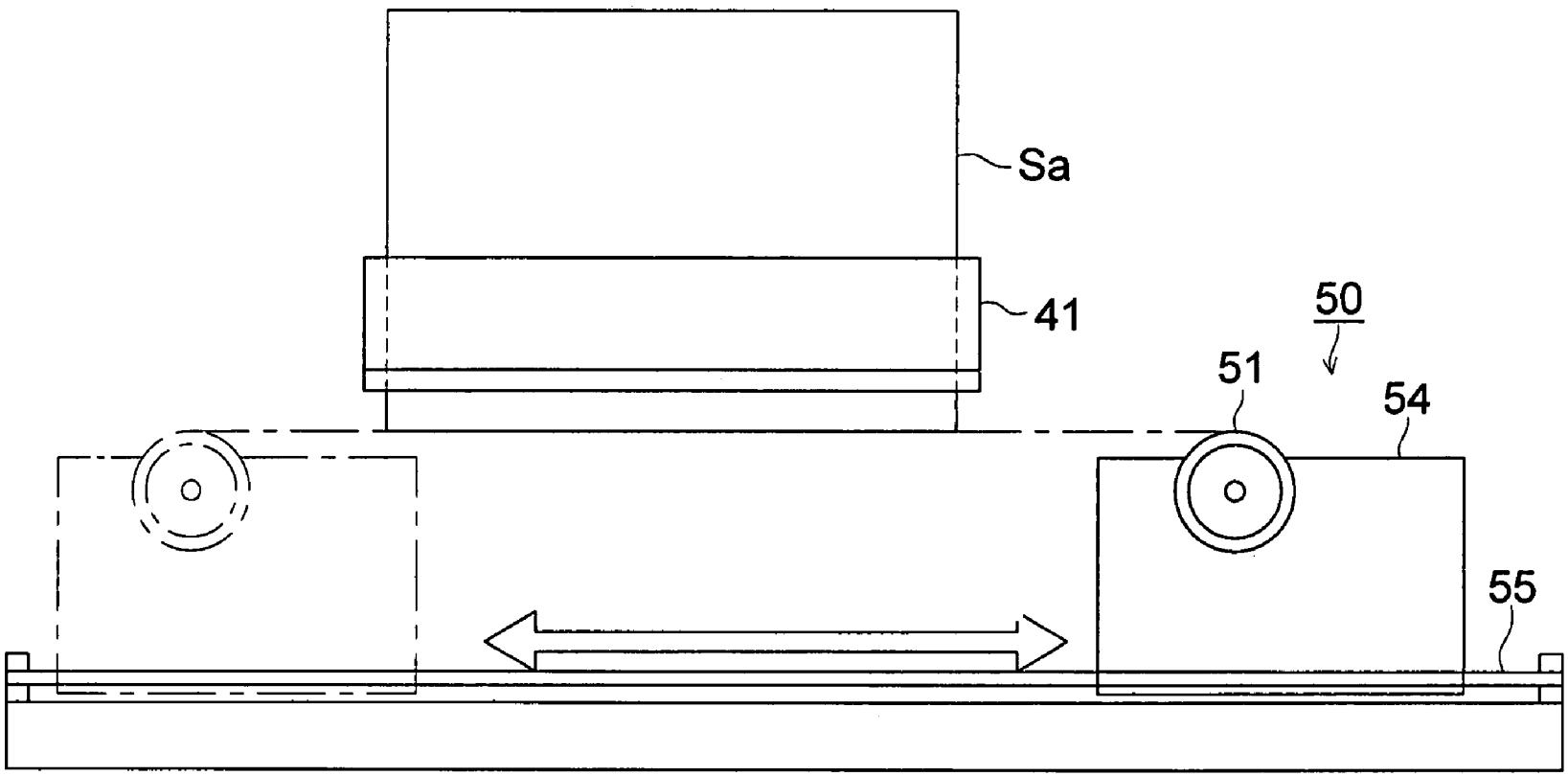
FIG. 9 is a side view of a pasting device and a holding device.
Figure 10:
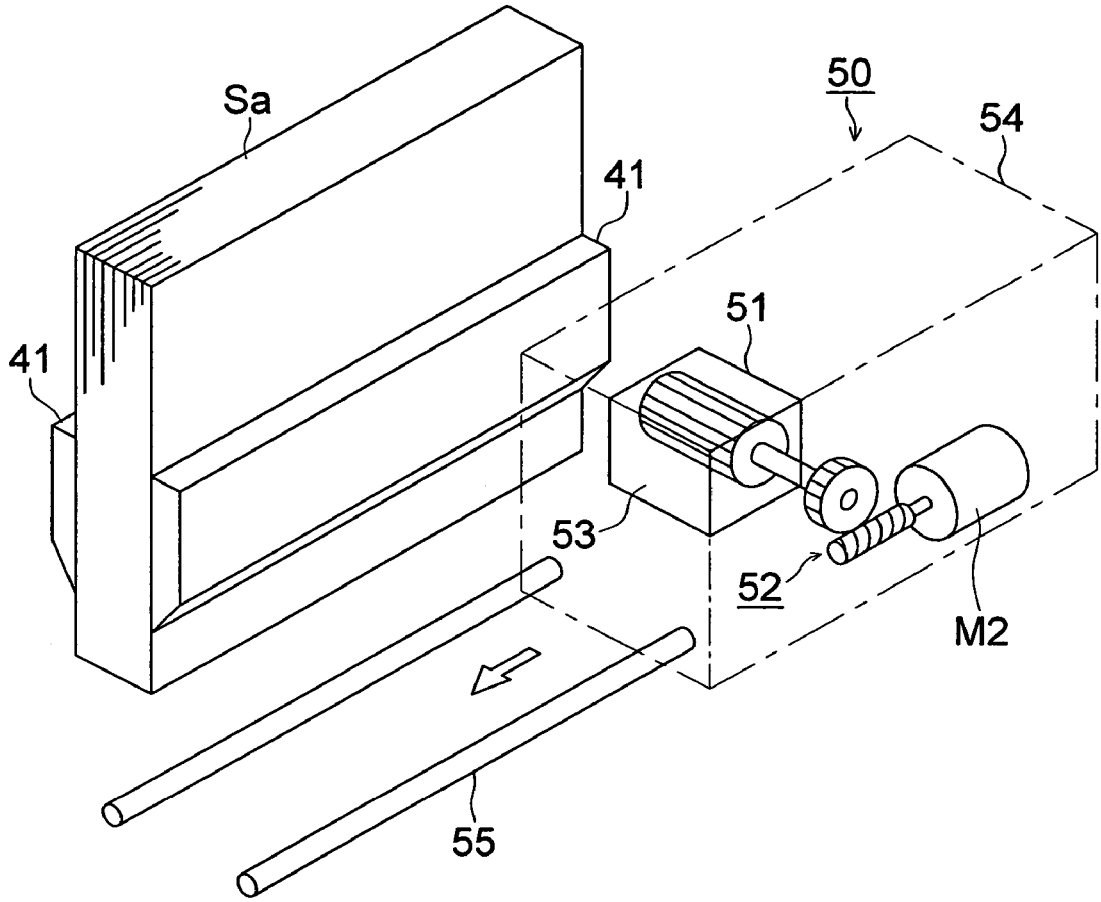
FIG. 10 is a perspective view of a pasting device and a holding device.

FIG. 7 is a sectional view of bookbinding apparatus B showing a process of coating paste on bundle of sheets Sa, FIG. 8 is a plan view of paste coating unit 50, FIG. 9 is a side view of paste coating unit 50 and holding unit 41 and FIG. 10 is a perspective view of paste coating unit 50 and holding unit 41.

Movable body 54 of paste coating unit 50 is moved by an unillustrated driving unit in the direction that is in parallel with the longitudinal direction of a bottom surface of sheet bundle Sa held by holding member 41 in the erected state.

The movable body 54 starts moving from the initial position, on the back side of bookbinding apparatus B, and is moved along guide member 55 to stop at a prescribed position on the front surface side of bookbinding apparatus B, and returns to the initial position after being driven to be reversed.

Coating roller 51 dipped in paste container 53 containing paste N is rotated by motor M2 and rotating unit 52. Forward movement or reciprocating movement of the movable body 54 makes coating roller 51 to coat paste N in the longitudinal direction of the bottom surface of sheet bundle Sa held in the erected state.

<Bonding between a Sheet Bundle and a Cover Sheet>

Figure 11:
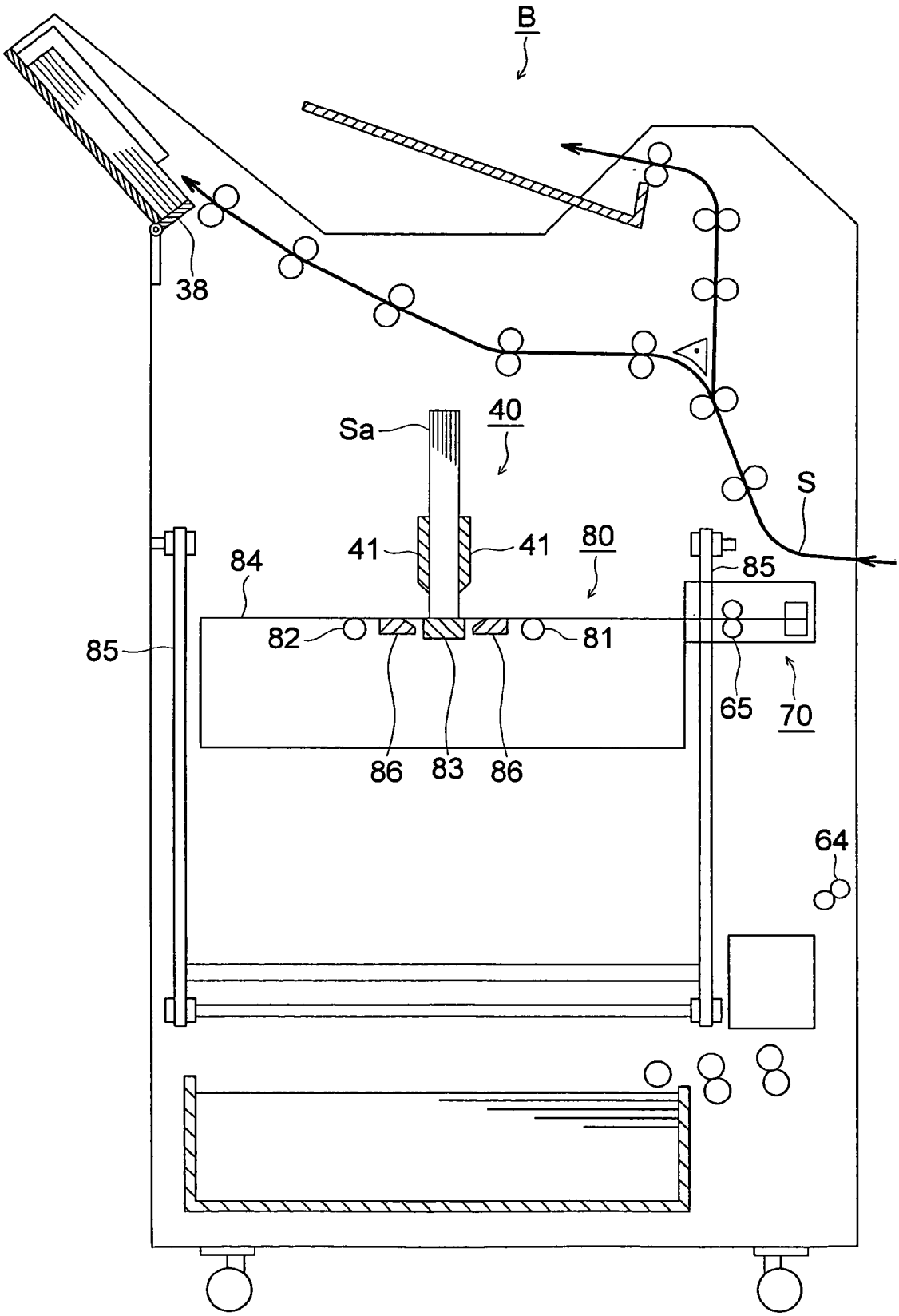
FIG. 11 is a cross sectional view of a bookbinding apparatus showing the process of bonding a cover sheet to the bundle of sheets.

FIG. 11 is a sectional view of bookbinding apparatus B showing a process to bond cover sheet K to sheet bundle Sa.

When belt 85 is operated by an unillustrated driving unit after completion of a process to coat paste on sheet bundle Sa, movable casing 84 is moved to the raised position. In this raised position, a central portion of cover K placed on pressing member 83 is brought into contact with a paste-coated surface of sheet bundle Sa to be pressed and stuck thereon.

Incidentally, ejection belt 101 is retreated in advance of the ascent of cover-sheet outfitting device 80, so that interference with sheet bundle Sa held in the erected state is prevented.

<Folding a Cover Sheet>

Figure 12:
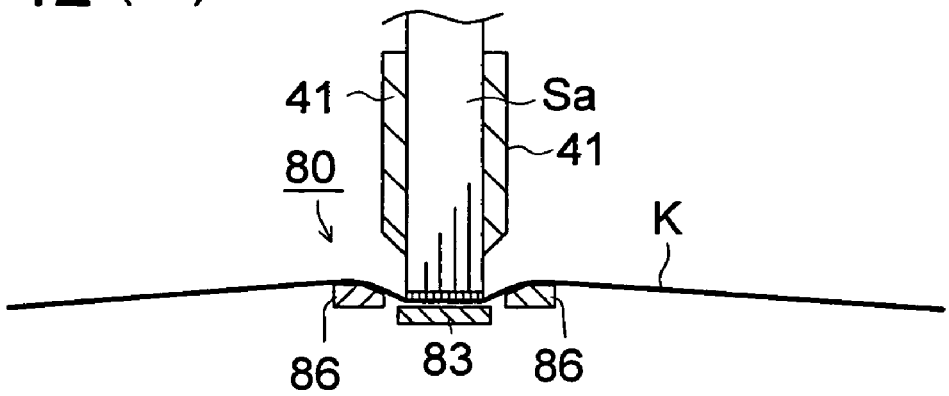
FIGS. 12(*a*), 12(*b*) and 12(*c*) are cross sectional views of a cover-sheet outfitting device and a bundle of sheets showing the process of folding the cover sheet.
Figure 12:
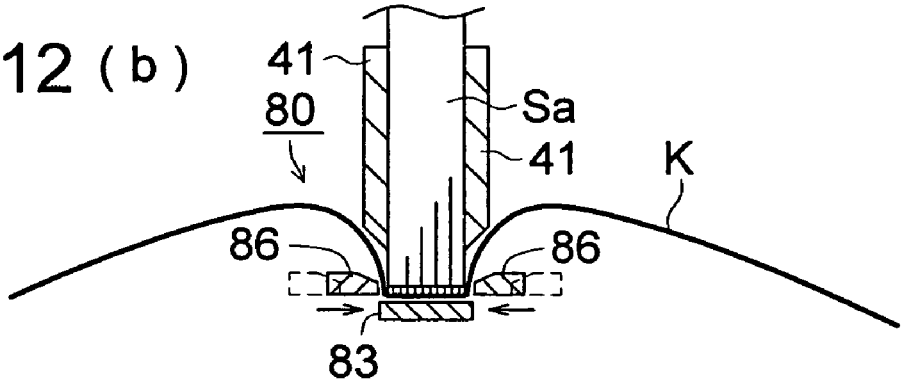
Figure 12:
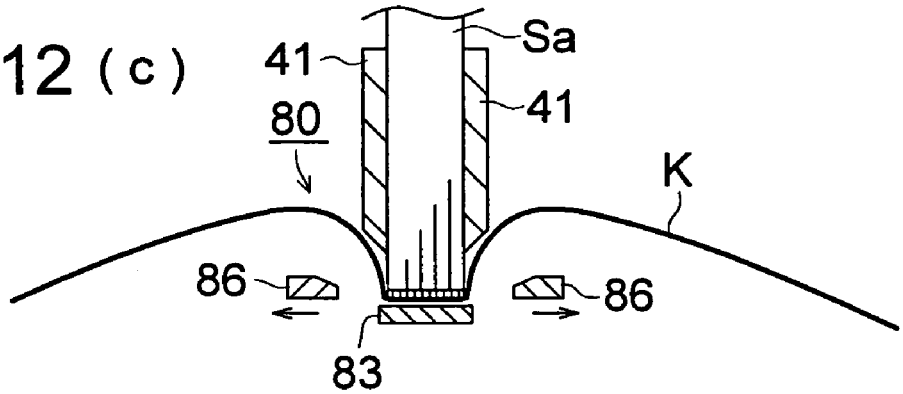

Each of FIGS. 12(*a*)-12(*c*) is a sectional view of cover-sheet outfitting device 80 and sheet bundle Sa showing each process of folding cover sheet K, and FIG. 12(*a*) shows a start of folding of a cover sheet, FIG. 12(*b*) shows the middle of folding of a cover sheet, FIG. 12(*c*) shows an end of folding of a cover sheet, respectively.

Figure 13:
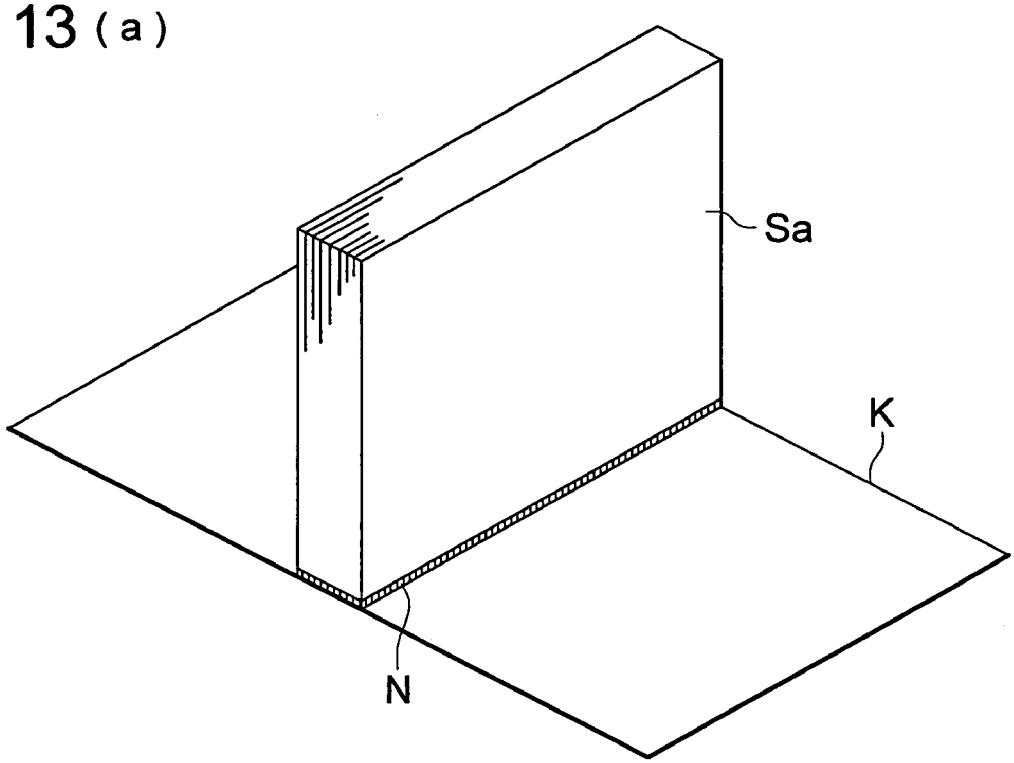
FIGS. 13(*a*) and 13(*b*) are a perspective view showing a bundle of sheets with the cover sheet pasted thereto, and a perspective view showing a booklet produced by wrapping-folding of the cover sheet onto a bundle of sheets.
Figure 13:
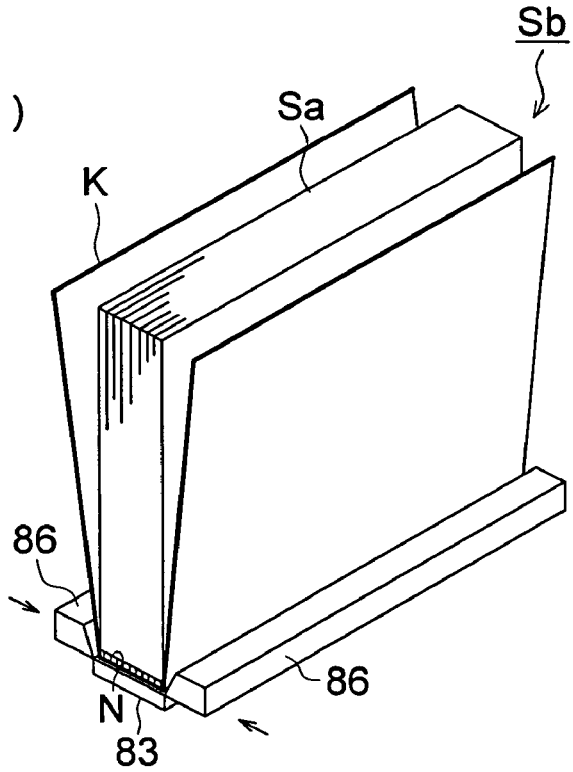

FIG. 13(*a*) is a perspective view of sheet bundle Sa on which cover sheet K is pasted, and FIG. 13(*b*) is a perspective view of booklet Sb that is made by conducting wrapping-folding with cover sheet K on sheet bundle Sa.

Cover-sheet outfitting device 80 holding cover sheet K is raised to the raised position (see FIG. 12(*a*)).

After that, the paired folding members 86 move in the horizontal direction toward the paste-coated surface of sheet bundle Sa to press both sides of the sheet bundle Sa for forming, and forms booklet Sb (see FIG. 12(*b*)). After bonding cover sheet K to the sheet bundle Sa and folding the cover sheet K, the paired folding members 86 are separated from booklet Sb (see FIG. 12(*c*)).

<Ejection of a Booklet>

Figure 14:
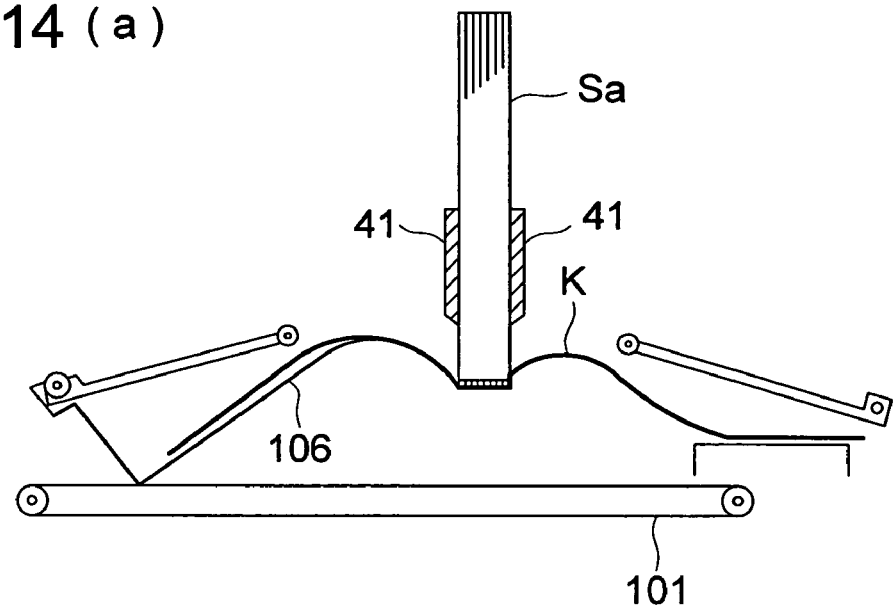
FIGS. 14(*a*), 14(*b*) and 14(*c*) are front views showing the process of ejecting a booklet made of a bundle of sheets and a cover sheet.
Figure 14:
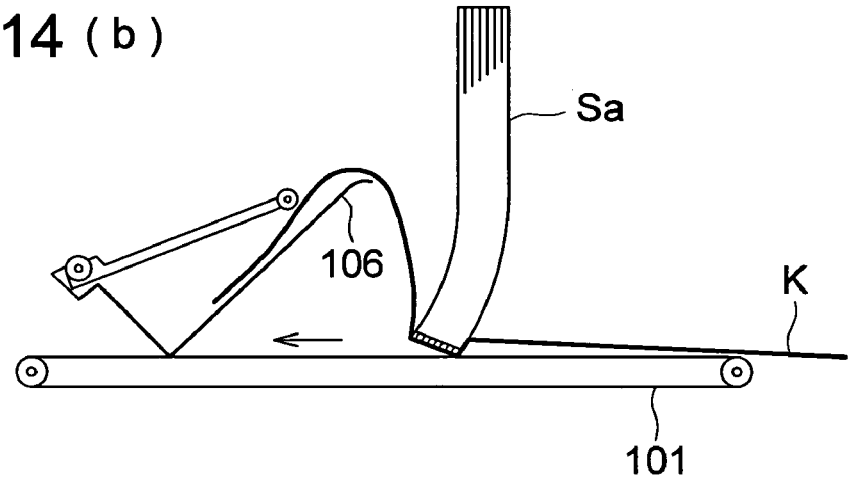
Figure 14:
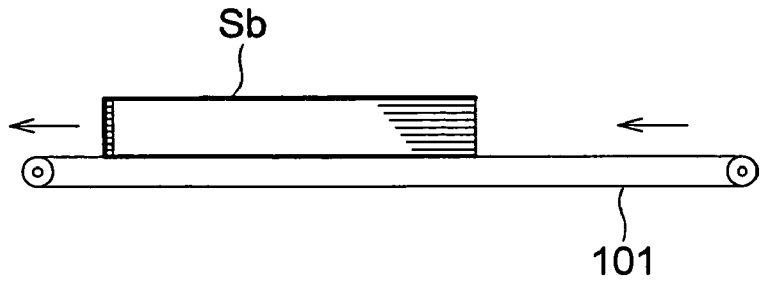

FIG. 14 is a front view showing an ejection process of booklet Sb composed of a bundle of sheet Sa and cover sheet K.

After an end of a folding process for cover sheet K, a descent of belt 85 makes cover-sheet outfitting device 80 to descend.

After an end of a folding process for cover K, a descent of belt 85 makes cover-sheet outfitting device 80 to descend to retreat, and then, cover-sheet supporting member 106 is swung to lift up a part of cover sheet K (see FIG. 14(*a*)).

Rotation of ejection belt 101 is started by unillustrated drive unit, and after sheet bundle Sa bonded with cover sheet K has descended, the lower end portion of it is moved toward the conveyance direction with ejection belt 101 due to the contact with the ejection belt 101.

Booklet Sb made of sheet bundle Sa bonded with cover sheet K is laid on turning ejection belt 101 and conveyed to be ejected from the apparatus (see FIG. 14(*b*)).

The bookbinding apparatus of the present invention can be formed to be an independent apparatus such that sheet bundle Sa processed and made by other image forming apparatuses may be loaded on sheet bundle loading unit 30 and a booklet bonded with a single wrapping-folded cover sheet for forming the front and back cover of the booklet may be made after a past coating process and a cover sheet outfitting process.

The following advantages are provided by the bookbinding apparatus and the image forming system of the present embodiment:

(1) The cover-sheet outfitting device and cover-sheet trimming device are integrally formed and are designed so that they can be raised and lowered. This arrangement easily enhances the cover sheet trimming precision. To be more specific, the cover-sheet outfitting device and the cover-sheet trimming device formed in an integrated structure ensures that there is no deviation in flatness between the cover-sheet outfitting device and the cover-sheet trimming device. Such being the case, the cover sheet having been conveyed to the cover-sheet trimming device from the cover-sheet outfitting device and having been trimmed exhibits accurate squareness between the end side trimmed orthogonal to the direction of conveyance and the end sides parallel to the direction of conveyance. Further, while the cover sheet having been trimmed is held by the cover-sheet outfitting device, it is fed to the cover sheet bonding position, where it is bonded to the bundle of sheets. This arrangement provides high-quality booklets wherein position of the bundle of sheets is matched to that of the cover sheet.

(2) The cover-sheet outfitting device is provided with an alignment device that regulates and positions the end sides of the cover sheet parallel to the direction of conveyance. The cover sheet trimming precision is enhanced by a higher precision of the angle between the end sides of the cover sheet in parallel to the direction of conveyance and the trimmed end side of the sheet.

(3) Since the cover-sheet outfitting device which can be raised and lowered is provided with an alignment device, the cover sheet before and after trimming can be positioned on the cover-sheet outfitting device. This arrangement ensures enhanced cover-sheet outfitting precision, improved booklet quality and a simplified apparatus structure.

(4) The cover sheet conveyed from the cover-sheet supply device is received at the lowered position by a single cover-sheet outfitting device, and is brought close to the bonding position at the raised position by the cover-sheet outfitting device. This simplified structure ensures a more reliable cover sheet wrapping bookbinding process and provides a high-quality booklet bonded with a single cover sheet forming the front and back cover of the booklet.

(5) The single alignment device positions the cover sheet in the width direction before trimming of the cover sheet by the cover-sheet trimming device, and regulates the width direction of the cover sheet after trimming and before bonding of the cover sheet. Thus, a more reliable cover sheet wrapping bookbinding process is ensured by a simplified apparatus structure and a high-quality booklet bonded with a single cover sheet forming the front and back cover of the booklet is provided.

(6) The cover sheet is raised while the position determined subsequent to trimming is kept unchanged. This arrangement ensures improved precision in the positioning of the cover sheet with respect to the bundle of sheets, whereby a high-quality booklet is provided.

(7) Even in the structure wherein the angle of the cover-sheet outfitting device can be adjusted with respect to the horizontal plane so that the cover sheet may be kept in close contact with the spine portion of the bundle of sheets, the cover-sheet trimming device is integral with the cover-sheet outfitting device. This arrangement improves the precision of the cover sheet trimming, independently of the angle of the cover-sheet outfitting device, whereby a booklet of higher quality is provided.

(8) The alignment device is provided with an ejection device for ejecting the sheet bundle bonded with the cover sheet, out of the apparatus. The booklet produced by a cover sheet wrapping bookbinding process is correctly ejected out of the apparatus by the ejection device arranged on the alignment device. Further, the apparatus structure is simplified by sharing of the same components by the alignment device and the ejection device, and the resultant space saving is achieved.

(9) The image forming system equipped with a bookbinding apparatus of the present embodiment applies a process of pasting to the sheets conveyed from the image forming apparatus body, wherein stable conveyance and alignment of these sheets are provided. This arrangement allows continuous processing of automatic bookbinding operations to be performed.

What is claimed is:

1. A bookbinding apparatus for bookbinding such that a cover sheet forms a front and a back cover by bonding the cover sheet and a spine portion of a bundle of sheets together, the bookbinding apparatus comprising:

a cover-sheet outfitting device which can be raised and lowered for holding and conveying a cover sheet to a cover sheet bonding position where the cover sheet is bonded to a bundle of sheets; and a cover-sheet trimming device which is integrally formed with the cover-sheet outfitting device and is raised and lowered together with the cover-sheet outfitting device and which trims a cover sheet conveyed from the cover-sheet outfitting device, to a predetermined length prior to bonding the cover sheet to the bundle of sheets.

2. The bookbinding apparatus of claim 1, wherein the cover-sheet outfitting device comprises:

a transporting member for transporting a cover sheet, and an alignment device for positioning the cover sheet by regulating an end side of the cover sheet parallel to a direction of transportation conducted by the transporting member.

3. The bookbinding apparatus of claim 1, wherein the cover-sheet outfitting device is driven by an elevation device such that the cover-sheet outfitting device can be raised and lowered for receiving a cover sheet transported from a cover-sheet supply device at a lowered position and for coming close to a bonding position where the cover-sheet outfitting device bonds the cover sheet at a raised position.

4. The bookbinding apparatus of claim 2, wherein the alignment device sets a position of a cover sheet in a width direction prior to trimming the cover sheet by the cover-sheet trimming device and sets a position of the cover sheet in a width direction after the trimming, prior to bonding the cover sheet to the bundle of sheets.

5. The bookbinding apparatus of claim 4, wherein the cover-sheet outfitting device is raised while maintaining a set position after setting a position of the cover sheet in a width direction after trimming conducted by the cover-sheet trimming device.

6. The bookbinding apparatus of claim 1, wherein an angle of the cover-sheet outfitting device and the cover-sheet trimming device is adjustable with respect to a horizontal plane.

7. The bookbinding apparatus of claim 2, wherein the alignment device comprises an ejection device for ejecting a bundle of sheets bonded with the cover sheet out of the apparatus.

8. A bookbinding apparatus for bookbinding such that a cover sheet forms a front and a back cover by bonding the cover sheet and a spine portion of a bundle of sheets together, the bookbinding apparatus comprising:

a cover-sheet outfitting device which can be raised and lowered in its entirety for holding and conveying a cover sheet to a cover sheet bonding position where the cover sheet is bonded to a bundle of sheets;

wherein the cover-sheet outfitting device comprises:

an alignment device for regulating an end of a cover sheet in a width direction so as to position the cover sheet; and a cover-sheet trimming device for trimming the cover sheet positioned by the alignment device, to a predetermined length prior to bonding the cover sheet to the bundle of sheets.

9. The bookbinding apparatus of claim 8, wherein the cover-sheet outfitting device is driven by an elevation device such that the cover-sheet outfitting device can be raised and lowered for receiving a cover sheet transported from a cover-sheet supply device at a lowered position and for coming close to a bonding position where the cover-sheet outfitting device bonds the cover sheet at a raised position.

10. The bookbinding apparatus of claim 9, wherein the alignment device sets a position of a cover sheet in a width direction prior to trimming the cover sheet by the cover-sheet trimming device and sets a position of the cover sheet in a width direction after the trimming, prior to bonding the cover sheet to the bundle of sheets.

11. The bookbinding apparatus of claim 10, wherein the cover-sheet outfitting device is raised while maintaining a set position after setting a position of the cover sheet in a width direction after trimming conducted by the cover-sheet trimming device.

12. The bookbinding apparatus of claim 8, wherein an angle of the cover-sheet outfitting device and the cover-sheet trimming device is adjustable with respect to a horizontal plane.

13. The bookbinding apparatus of claim 8, wherein the alignment device comprises an ejection device for ejecting a bundle of sheets bonded with the cover sheet out of the apparatus.

* * * * *